United States Patent [19]

Ovens

[11] Patent Number: 4,961,471

[45] Date of Patent: Oct. 9, 1990

[54] POST HOLE DIGGER

[76] Inventor: Ronald K. Ovens, 2 North Street, Beckenham, Western Austrailia, Australia

[21] Appl. No.: 380,889

[22] Filed: Jul. 17, 1989

[30] Foreign Application Priority Data

Jul. 21, 1988 [AU] Australia ..... PI9395

[51] Int. Cl.[5] ..... E21B 7/02; E21B 3/02

[52] U.S. Cl. ..... 175/170; 173/22

[58] Field of Search ..... 175/170, 162, 203, 195; 173/22, 28, 18

[56] References Cited

U.S. PATENT DOCUMENTS 2,217,300 10/1940 Templeton ..... 175/170
2,468,319 4/1949 Adams ..... 173/22 X
2,562,276 7/1951 Kandle ..... 175/203
2,568,959 9/1951 Illies ..... 173/22 X
2,746,720 5/1956 Cannon ..... 175/170 X
3,022,839 2/1962 Troche ..... 175/170 X

*Primary Examiner*—Stephen J. Novosad
*Attorney, Agent, or Firm*—Jeffers, Hoffman & Niewyk

[57] ABSTRACT

A post hole digger comprising an auger and motor assembly pivotably mounted to one end of an elongate support structure, the other end of which being mounted via a pivot connection to a support base either mounted or adapted to be mounted to a vehicle, the elongate support structure being adapted to extend to permit the auger to be moved towards or away from the support base and the pivot connection permitting the auger to be raised or lowered or moved laterally relative to said support base.

6 Claims, 3 Drawing Sheets

POST HOLE DIGGER

This invention relates to a post hole digger wherein the auger is driven by an individual motor arranged as a single assembly with the auger.

This form of motorised auger is currently in use as a portable post hole digger. It is necessary for two operators to be available to operate this type of digger, respective handles being provided on two opposite sides of the auger and motor assembly to be gripped by the respective operators. This construction requires the operators to support the assembly with the auger in the required vertical dispostion, and for the operators to act as the reaction to the torque of the motor so that the auger will rotate relative to the motor to effect the required digging action. The operators are thus required to be of considerable physical strength, as in hard or rocky ground they are required to exert substantial forces on the motor to prevent rotation thereof. In addition the impact loading on the operators may be beyond their physical strength when the auger unexpectedly strikes a rock or other form of high resistance to the rotation of the auger.

It will further be appreciated that there are substantial risks of injury to the operators both as a result of the high physical loads generated by the operation of the digger, and from the potential injury in the event that the operators loose control of the digger, which may arise as a result of the loss of an adequate grip thereon by one or both of the operators.

There has, of course, previously been proposed a wide range of post hole diggers that are mounted on the hydraulic lift mechanism of tractors, but because of the transport difficulties associated with this form of equipment, it is not practical for use in a number of situations. In particular, authorities responsible for the maintenance of roads, parks and the like, where fences or guide posts are employed, are frequently required to dig a single or small number of post holes at locations remote from access to a tractor mounted post hole diggers. This is particularly so in regard to road and highway maintenance crews who carry out on the spot maintenance and in any day travel substantial distances.

It is therefore the object of the present invention to provide a post hole digger that may be conveniently transported or mounted on a conventional truck without the requirement of supporting auxilliary equipment, such as hydraulic systems or lifting gear, and may be convieniently operated by one or two persons with a high degree of skill and safety.

With this object in view, there is provided a post hole digger comprising a support base adapted to be, or mounted on, a vehicle, a post hole digging auger and motor assembly, an elongated support structure interconnecting said support base and said auger and motor, a pivot connection connecting said elongated support structure to said support base, said elongated support structure being extendible or retractable to enable movement of said auger and motor assembly towards or away from said support base, said auger and motor assembly being mounted from said elongated support structure so that in a free state the auger is suspended substantially vertically, and control handle means adapted to be manually gripped to guide said auger and resist lateral forces occurring during operation of the auger.

In one possible arrangement, the elongated support structure might be formed by a single arm. Conveniently, the pivot connection of the elongated support structure to the support base enables the auger and motor assembly to be selectably moved up and down or transversely relative to the support base. In one particularly preferred construction, the elongated structure comprises a telescopic connection of at least two parts, one part being connected to said support base and the other end being connected to said auger and motor assembly.

The telescopic aspect of the elongated structure supporting the auger and the motor assembly, and the ability of the structure to pivot in a manner enabling transverse movement of the auger relative to the support base, enables the auger to be operated within a considerable area adjacent the vehicle with the vehicle remaining in a fixed position. This is particularly advantageous for maintenance operations where there are frequently limitations as to where the vehicle may be positioned relative to the location of the hole to be dug.

Also the telescopic aspect of the structure enables the auger to be maintained in a vertical dispostion whilst digging as the effective length of the structure may vary, in accordance with the variation in the height of the point of connection between the auger and motor assembly and the structure, as the auger penetrates into the ground. Further, the telescopic structure being connected to the vehicle provides the prime reaction to the torque of the engine, thereby reducing the physical strain on and safety risk to the operators.

Conveniently, the telescopic structure comprises a pair of laterally spaced members, each of a telescopic construction, preferably with cross-bracing therebetween. Portion of the motor and auger assembly is received between laterally spaced members at the other or outer end of the structure where the pivotal connection between the assembly and the structure is provided.

Conveniently, the control handle means comprises at least one (and preferably two) handle member extending beyond the auger and motor assembly such that the or each handle member is pivotally mounted whereby the position of a gripping portion of the or each handle member can be selected during operation of the auger. This enables an operator to have the or each handle pivotted upwardly when the auger is at or approaching its fully extended position. This enables the operator to operate the equipment in a comfortable position regardless of the position of the auger during a digging operation.

One preferred embodiment of the present invention will hereinafter be described with reference to the accompanying drawings, in which.

Figure 1:
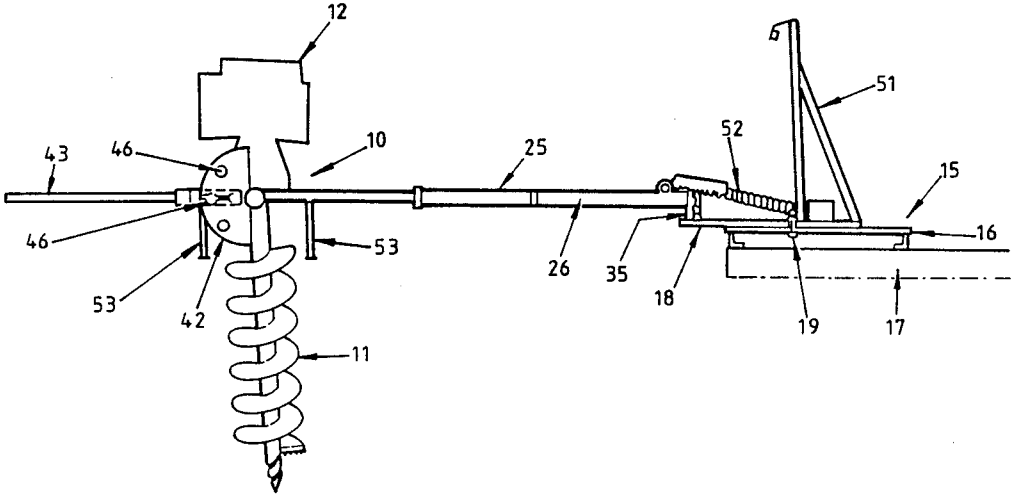
FIG. 1 is a side elevation of the post hole digger mounted on the tray of a truck.
Figure 2:
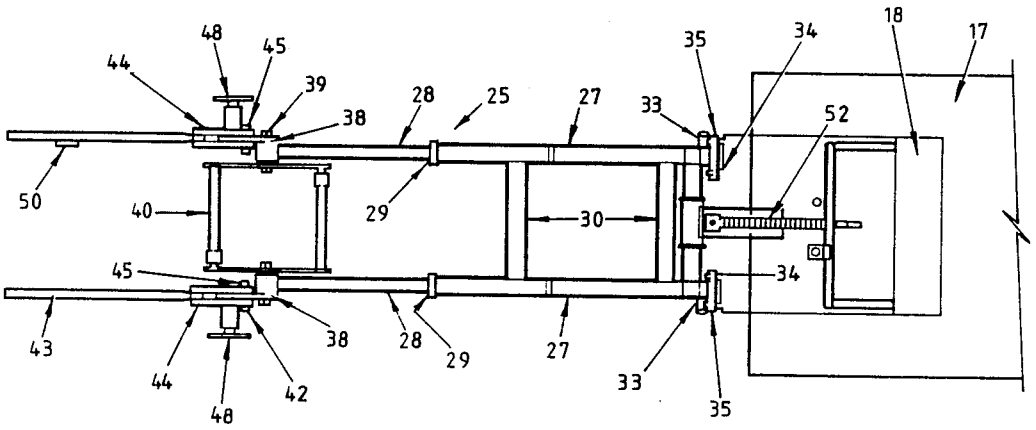
FIG. 2 is a plan view of the post hole digger as seen in FIG. 1.
Figure 3:
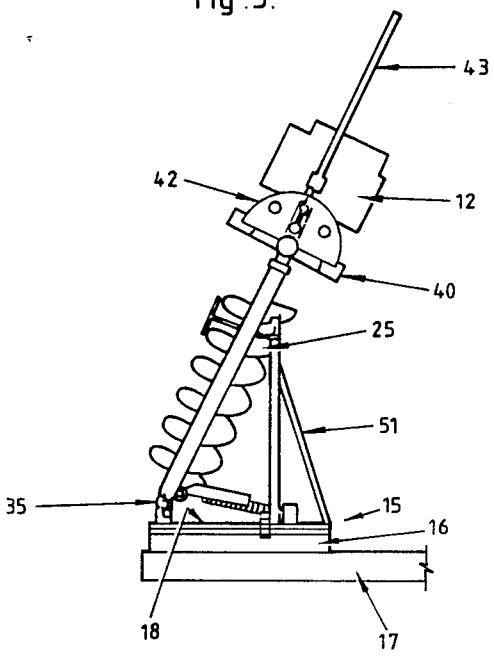
FIG. 3 is a side view of the post hole digger in a retracted position for transportation.

Referring now to FIG. 1, the auger and motor assembly 10 comprises a conventional auger 11 and an internal combustion engine 12. The auger 11 and engine 12 may be an integrated unit with the engine 12 driving the auger 11 through a suitable clutch and transmission as is known. A turntable assembly 15 is provided for connecting the device to the tray 17 of a conventional truck or some other similar vehicle. The turntable assembly 15 includes a base 16 rigidly attached to the tray 17 and is preferably mounted adjacent to one edge (end or side) of the tray 17. A plate 18 is supported on the base 16 in a face to face relation, and attached thereto by a pivot pin 19 so that the plate 18 may rotate about the vertical axis of the pin 19. It will be noted that the pin 19 is located eccentric to the centre of the base 16 and plate 18 so that when in the position as shown in FIGS. 1 and 2, the plate 18 overhangs the base 16 and the edge of the tray 17 of the truck. As can be seen in FIG. 3, when the plate 18 is rotated through 180° from the position shown in FIG. 1, the plate 18 is displaced inwardly with respect to the edge of the tray 17 of the truck.

A boom structure 25 (as seen in FIGS. 1 and 2 is connected to the plate 18 by a horizontal pivot formed by aligned bearings 33,35. The structure 25 comprises a pair of laterally spaced telescopic beams or arms 26 comprising respective outer sections 27 and inner sections 28, which are slidably received within the respective open end 29 of the outer sections 27. Lateral brace members 30 extend between and are secured to the respective outer sections 27 to form therewith a rigid structure.

Secured to the respective ends of the outer sections 27 of the boom structure 25 are aligned transverse bearing sleeves 33 which are received in bearing brackets 34 secured to the plate 18 of the turntable 15. Removable bearing pins 35 pivotally connect the bearing sleeves 33 to the brackets 34, whereby the boom 35 may pivot relative to the turntable 15 about a horizontal axis constituted by the bearing pins 35.

At the free end of the inner sections 28 of the beams 26, are further bearing sleeves 38 and co-operating bearing pins 39, which pivotally secure a motor and auger assembly frame 40 to the inner sections 28 of the arms 26.

Rubbering bushes are preferably provided between the pins 39 and sleeves 38 to reduce the transmission of vibrations from the engine to the operators. Also depth control stop pegs 53 are provided to limit the depth of hole that may be dug, and then permit the auger to be held at the full depth for a period to clean out the hole.

Secured to the bearing bushes 38 are respective substantially semi-circular plates 42, as best seen in FIG. 1. Pivotally mounted to each plate 42 is a hand bar 43 having respective Y-shaped end portions 44, to receive therein the plates 42. The hand bars 43 are pivotally connected to the respective plates 42 by the pivot pins 45, and a series of apertures 46 are provided in each plate 42, each on an equal radius with respect to the pivot pin 45. Respective spring loaded locking pins 48 are provided on the Y-shaped end portions 44 of the hand bars 43 which may be selectively engaged with any one of the apertures 46. This form of mounting of the hand bars 43 enable the height to be adjusted to suit the operator as the auger penetrates into the ground when in operation.

A throttle control 50 for the engine 12 may be fitted to one of the hand bars 43 at a convenient location for actuation by one of the operators.

The engine and auger assembly 12 is suitably fixedly mounted in the frame 40 so that the centre of gravity of the engine and auger assembly is well below the axis of the bearing pins 39. This ensures that the auger will freely hang with the auger axis vertical. The telescopic arms 26 pivot about the bearing pins 35 as the auger digs into the ground, and adjust in length so that the auger remains vertical.

During transportation the telescopic beams may be fully retracted and pivotally moved into an approximately vertical position with the beams and the motor and auger assembly in a generally side by side relation A frame 51 is provided on the plate 18 against which the telescoped beams and the motor and auger assembly may rest to maintain the vertical stored position. A tension spring 52 may be connected between the plate 18 and one of the brace members to partly counter the weight of the beam 25 and the engine and auger, particularly when they are being lifted to the transportation position.

I claim:

1. A post hole digger comprising a support base adapted to be mounted on a vehicle for a pivotal movement about a vertical axis, a post hole digging auger and motor assembly, an elongated support structure pivotally connected at one end to said support base about a horizontal axis, said auger and motor assembly being pivotally connected to the other end of said elongated support structure about a horizontal axis, said elongated support structure being extendible or retractable to enable positioning of said auger and motor assembly at a desired location and to adjust as the auger and motor assembly lowers and penetrates the ground, said auger and motor assembly being suspended from said elongated support structure so that in a free state the auger and motor assembly is suspended substantially vertically, and control handle means adapted to be manually gripped to guide said auger and motor assembly and resist lateral forces occurring during operation of the auger and motor assembly.

2. The post hole digger according to claim 1, wherein said elongated structure comprises a telescopic structure.

3. The post hole digger according to claim 1, wherein said elongated structure includes a pair of laterally spaced parallel telescopic members each comprising at least two parts telescopically interconnecting with one another, said auger and motor assembly being pivotally mounted to and between outer ends of the parts of said members outermost from the support base.

4. The post hole digger according to claim 1, 2 or 3, wherein said support base includes a first support element adapted to be fixedly mounted on a vehicle, a second support element pivotally mounted to said first support element for rotation about a substantially vertical axis, and said elongated structure being pivotally mounted on said second support element.

5. The post hole digger according to claim 1, 2 or 3, wherein said control handle means comprises at least one handle member attached to the elongated support structure extending beyond the auger and motor assembly, each handle member having a gripping portion and being pivotally mounted on the elongated support structure and selectively lockable whereby the position of the gripping portion of each handle member can be selectively positioned during operation of the auger and motor assembly

6. The post hole digger according to claim 5, wherein said control handle means comprises a handle member pivotally connected to said elongated support structure, said handle member including a gripping portion, such that the gripping portion of each handle member extends beyond the auger and motor assembly, and each said handle member is selectively lockable to provide a plurality of predetermined positions relative to the elongated support structure.

* * * * *